United States Patent [19]

Chen et al.

[11] Patent Number: 4,556,819

[45] Date of Patent: Dec. 3, 1985

[54] COLOR PICTURE TUBE HAVING INLINE ELECTRON GUN WITH COMA CORRECTION MEMBERS

[75] Inventors: Hsing-Yao Chen, Landisville; Richard H. Hughes, Lancaster, both of Pa.

[73] Assignee: RCA Corporation, Princeton, N.J.

[21] Appl. No.: 560,794

[22] Filed: Dec. 13, 1983

[51] Int. Cl.[4] ..... H01J 29/76

[52] U.S. Cl. ..... 313/413

[58] Field of Search ..... 313/413, 412

[56] References Cited

U.S. PATENT DOCUMENTS

| | | | |
|---|---|---|---|
| Re. 29,895 | 1/1979 | Murata et al. | 313/411 |
| 3,164,737 | 1/1965 | Messineo et al. | 313/69 |
| 3,196,305 | 7/1965 | Barkow | 313/69 |
| 3,534,208 | 10/1970 | Krackhardt et al. | 313/77 |
| 3,548,249 | 12/1970 | Yoshida et al. | 313/13 |
| 3,594,600 | 7/1971 | Murata et al. | 313/79 |
| 3,860,850 | 1/1975 | Takenaka et al. | 313/428 |
| 3,873,879 | 3/1975 | Hughes | 315/13 C |
| 4,225,804 | 9/1980 | Bekaert et al. | 313/412 |
| 4,346,327 | 8/1982 | Barten | 313/413 |
| 4,370,592 | 1/1983 | Hughes et al. | 313/414 |
| 4,388,552 | 6/1983 | Greninger | 313/414 |
| 4,396,862 | 8/1983 | Hughes | 313/413 |

FOREIGN PATENT DOCUMENTS

| | | |
|---|---|---|
| 2015247 | 9/1979 | United Kingdom . |
| 1569829 | 6/1980 | United Kingdom . |

OTHER PUBLICATIONS

"Electron Gun Shunt Designs for Coma Correction" by P. T. Greninger, *Technical Notes*, A Publication of RCA, Princeton, N.J., TN No. 1300, Apr. 1982, 2 pages.

*Primary Examiner*—Palmer C. DeMeo

*Attorney, Agent, or Firm*—Eugene M. Whitacre; Dennis H. Irlbeck

[57] ABSTRACT

The present invention provides an improvement in a color picture tube having an inline electron gun for generating and directing three inline electron beams, comprising a center beam and two outer beams, along initially coplanar paths toward a screen of the tube. The beams pass through a deflection zone adapted to have two orthogonal magnetic deflection fields established therein. A first of the fields causes deflection of the beams perpendicular to the inline direction of the beams, and a second of the fields causes deflection parallel to the inline direction of the beams. The improvement comprises the electron gun including four magnetically permeable members located near the exit of the electron gun in a fringe portion of said deflection zone. A first and a second of the members are located between the center beam path and a first and second outer beam path, respectively. A third and a fourth of said members are spaced from the first and second members, respectively, and are located on the outside of the respective outer beam paths. The first and third members and the second and fourth members have means for bypassing a part of the fringe portion of the first of the two orthogonal magnetic deflection fields, at the members, around the respective outer beam paths, while allowing another part of the same fringe portion, at the members, to pass through the respective outer beam paths. The first and second members have means for bypassing a part of the fringe portion of the first of the two orthogonal deflection fields, at the members, around the center beam path, while allowing another part of the same fringe portion, at the members, to pass through the center beam path.

4 Claims, 5 Drawing Figures

COLOR PICTURE TUBE HAVING INLINE ELECTRON GUN WITH COMA CORRECTION MEMBERS

BACKGROUND OF THE INVENTION

The present invention relates to a color picture tube having an improved inline electron gun, and particularly to an improvement in the gun for obtaining equal raster sizes (also called coma correction) within the tube.

An inline electron gun is one designed to generate or initiate preferably three electron beams in a common plane and direct those beams along convergent paths to a point or small area of convergence near the tube screen.

A problem that exists in a color picture tube having an inline gun is coma distortion wherein the sizes of the electron beam rasters scanned on the screen by an external magnetic deflection yoke are different because of the eccentricity of the two outer beams with respect to the center of the yoke. Messineo et al., U.S. Pat. No. 3,164,737, issued Jan. 5, 1965, teaches that a similar coma distortion caused by using different beam velocities can be corrected by use of a magnetic shield around the path of one or more beams in a three gun assembly. Barkow, U.S. Pat. No. 3,196,305, issued July 20, 1965, teaches the use of magnetic enhancers adjacent to the path of one or more beams in a delta gun, for the same purpose. Krackhardt et al., U.S. Pat. No. 3,534,208, issued Oct. 13, 1970, teaches the use of a magnetic shield around the middle one of three inline beams, for coma correction. Yoshida et al., U.S. Pat. No. 3,548,249, issued Dec. 15, 1970, teaches the use of C-shaped elements positioned between the center and outer beams to enhance the effect of the vertical deflection field on the center beam. Murata et al., U.S. Pat. No. 3,594,600, issued July 20, 1971, teaches the use of C-shaped shields around the outer beams, with the open sides of the members facing each other. These shields appear to shunt the vertical deflection field around all three beams. Takenaka et al., U.S. Pat. No. 3,860,850, issued Jan. 14, 1975, teaches the use of V-shaped enhancement members located above and below three inline beams and C-shaped shields around the two outer beams. Hughes, U.S. Pat. No. 3,873,879, issued March 25, 1975, teaches the use of small disc-shaped enhancement elements above and below the center beam and ring shaped shunts around the two outer beams.

All of the foregoing patents solved various raster size problems. More recently, U.S. Pat. No. 4,396,862, issued to Hughes on Aug. 2, 1983, discloses correction members that weaken the effect of the horizontal magnetic deflection field on the center beam and weaken the effect of both horizontal and vertical deflection fields on both of the outer beams. Such coma correction members have worked well on inline electron guns made to recent date. However, newer inline electron guns, such as disclosed in U.S. Pat. No. 4,370,592, issued to Hughes et al. on Jan. 25, 1983, and in U.S. Pat. No. 4,388,552, issued to Greninger on June 14, 1983, have coma correction problems which are similar but of a much lower magnitude. Although these problems can be solved by use of the coma correction members described in the Hughes U.S. Pat. No. 4,396,862, such members must be made so thin that they are very difficult to handle and become distorted when welded. Therefore, there is a need for a new coma correction member design, which will provide the more subtle lower magnitude coma correction required in the aforementioned newer electron guns, with the use of material having adequate thickness for ease of handling and which will not distort when welded. The present invention fulfills this need for a new coma correction member design.

SUMMARY OF THE INVENTION

The present invention provides an improvement in a color picture tube having an inline electron gun for generating and directing three inline electron beams, comprising a center beam and two outer beams, along initially coplanar paths toward a screen of the tube. The beams pass through a deflection zone adapted to have two orthogonal magnetic deflection fields established therein. A first of the fields causes deflection of the beams perpendicular to the inline direction of the beams, and a second of the fields causes deflection parallel to the inline direction of the beams. The improvement comprises the electron gun including four magnetically permeable members located near the exit of the electron gun in a fringe portion of the deflection zone. A first and a second of the members are located between the center beam path and a first and a second outer beam path, respectively. A third and a fourth of the members are spaced from the first and second members, respectively, and are located on the outsides of the respective outer beam paths. The first and third members and the second and fourth members have means for bypassing a part of the fringe portion of the first of the two orthogonal magnetic deflection fields, at the members, around the respective outer beam paths, while allowing another part of the same fringe portion, at the members, to pass through the respective outer beam paths. The first and second members have means for bypassing a part of the fringe portion of the first of the two orthogonal deflection fields, at the members, around the center beam path, while allowing another part of the same fringe portion, at the members, to pass through the center beam path.

DETAILED DESCRIPTION OF THE PREFERRED EMBODIMENT

Figure 1:
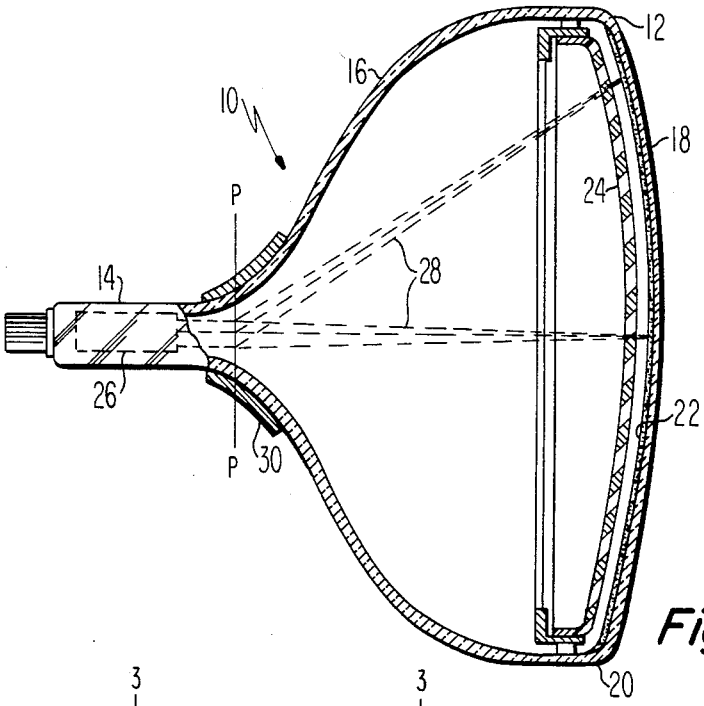
FIG. 1 is a plan view, partly in axial section, of a shadow mask color picture tube embodying the invention.

FIG. 1 is a plan view of a rectangular color picture tube 10 having a glass envelope comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A three-color phosphor screen 22 is carried by the inner surface of the faceplate 18. The screen 22 is preferably a line screen with the phosphor lines extending substantially perpendicular to the high frequency raster line scan of the tube (normal to the plane of FIG. 1). A multi-apertured color-selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along initially coplanar convergent paths through the mask 24 to the screen 22.

The tube of FIG. 1 is designed to be used with an external magnetic deflection yoke 30, such as the self-converging yoke, shown surrounding the neck 14 and funnel 12 in the neighborhood of their junction. When activated, the yoke 30 subjects the three beams 28 to vertical and horizontal magnetic flux which causes the beams to scan horizontally and vertically, respectively, in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the electron gun 26. For simplicity, the actual curvature of the deflected beam paths in the deflection zone is not shown in FIG. 1.

Figure 2:
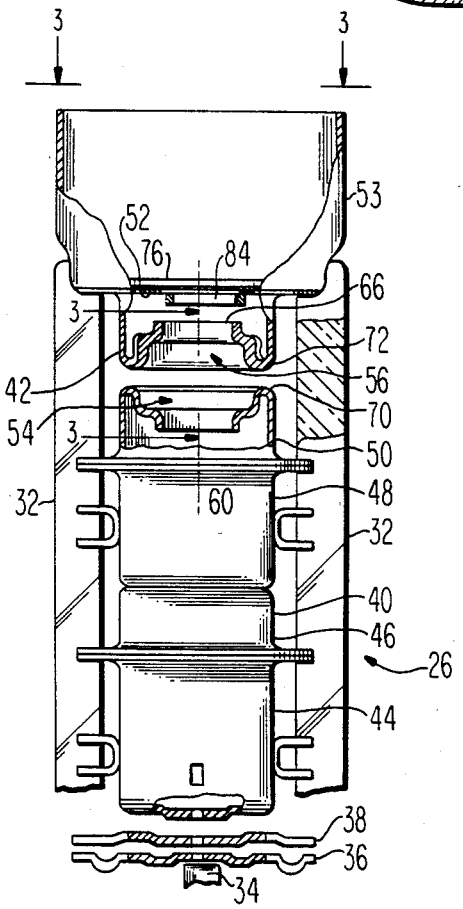
FIG. 2 is a partial axial section view of the electron gun shown in dashed lines in FIG. 1.
Figure 3:
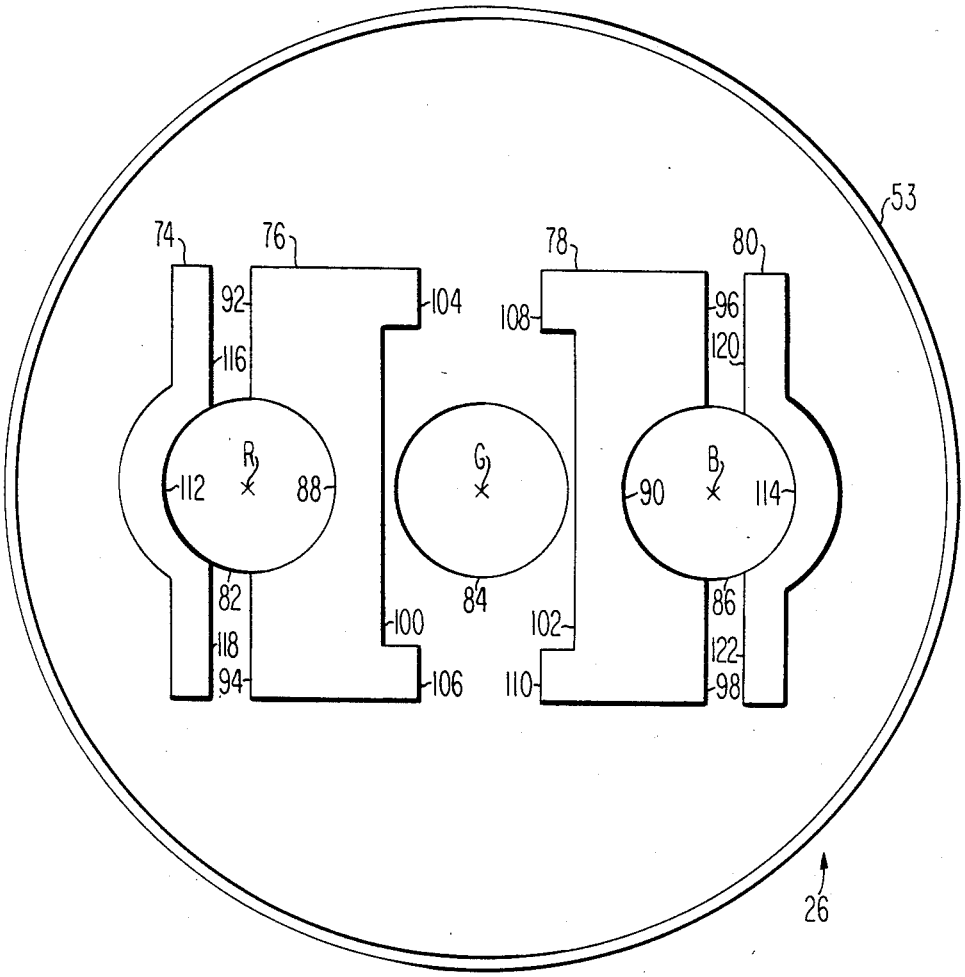
FIG. 3 is an end view of the electron gun of FIG. 2 taken at line 3—3 in FIG. 2.

The details of the electron gun 26 are shown in FIGS. 2 and 3. The gun 26 comprises two glass support rods 32 on which the various electrodes are mounted. These electrodes include three equally spaced coplanar cathodes 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. Each of the G1 through G4 electrodes has three inline apertures therein to permit passage of three coplanar electron beams. The main electrostatic focusing lens in the gun 26 is formed between the G3 electrode 40 and the G4 electrode 42. The G3 electrode 40 is formed with four cup-shaped elements 44, 46, 48 and 50. The open ends of two of these elements, 44 and 46, are attached to each other, and the open ends of the other two elements, 48 and 50, are also attached to each other. The closed end of the third element 48 is attached to the closed end of the second element 46. Although the G3 electrode 40 is shown as a four-piece structure, it could be fabricated from any number of elements, including a single element of the same length. The G4 electrode 42 also is cup-shaped, but has its open end closed with an apertured plate 52. A shield cup 53 is attached to the plate 52 at the exit of the gun 26.

The facing closed ends of the G3 electrode 40 and the G4 electrode 42 have large recesses 54 and 56, respectively, therein. The recesses 54 and 56 set back the portion of the closed end of the G3 electrode 40 that contains three apertures 58, 60 and 62, from the portion of the closed end of the G4 electrode 42 that contains three apertures, 64, 66 and 68. The remaining portions of these closed ends of the G3 electrode 40 and the G4 electrode 42 form rims 70 and 72, respectively, that extend peripherally around the recesses 54 and 56. The rims 70 and 72 are the closest portions of the two electrodes 40 and 42.

Located on the bottom of the shield cup 53 are four magnetically permeable coma correction members 74, 76, 78 and 80. The bottom of the shield cup 53 includes three apertures, 82, 84 and 86, through which the electron beams pass. The centers of the undeflected electron beam paths are designated R, G and B. The R and B paths are the outer beam paths, and the G path is the center beam path. The member 76 is located between the center beam path G and the outer beam path R, and the member 78 is located between the center beam path G and the side beam path B. The member 74 is located outside the outer beam path R, and the member 80 is located outside the outer beam path B.

The outward sides of the members 76 and 78 that face the outer beam paths R and B include inwardly curved arcuate portions, 88 and 90, which conform to the apertures 82 and 86, respectively, to partially surround the outer beam paths. The remaining portions, 92 and 94, and 96 and 98, of the outward sides of the members 76 and 78, respectively, extend outward toward the members 74 and 80, respectively. The inward sides of the members 76 and 78 that face the center beam path G include straight central portions 100 and 102, respectively, and inwardly extending legs, 104 and 106, and 108 and 110, at the opposite ends thereof, respectively.

The inward sides of the members 74 and 80 that face the outer beam paths R and B include outwardly curved arcuate portions, 112 and 114, which conform to the apertures 82 and 86, respectively, to partially surround the outer beam paths. The remaining portions 116 and 118, and 120 and 122, of the inward sides of the members 74 and 80, respectively, extend inward toward the members 76 and 78, respectively.

The four coma correction members 74, 76, 78 and 80 are located in a fringe portion of the deflection zone of the color picture tube 10. In operation, the yoke 30 establishes two orthogonal magnetic deflection fields in the deflection zone of the tube. These fields are generally known as the vertical and horizontal deflection fields, even though the faceplate of the tube may be oriented other than vertically. The vertical deflection field has lines of flux that extend horizontally and cause deflection of the electron beams perpendicularly to the lines of flux. In the electron gun 26, the vertical deflection is perpendicular to the inline direction of the inline electron beams, and the lines of flux that cause vertical deflection are substantially parallel to the inline direction of the inline electron beams. The horizontal deflection field has lines of flux that extend vertically and cause deflection of the electron beams perpendicularly to the lines of flux. In the electron gun 26, the horizontal deflection is parallel to the inline direction of the inline electron beams, and the lines of flux that cause horizontal deflection are substantially perpendicular to the inline direction of the inline electron beams.

Figure 4:
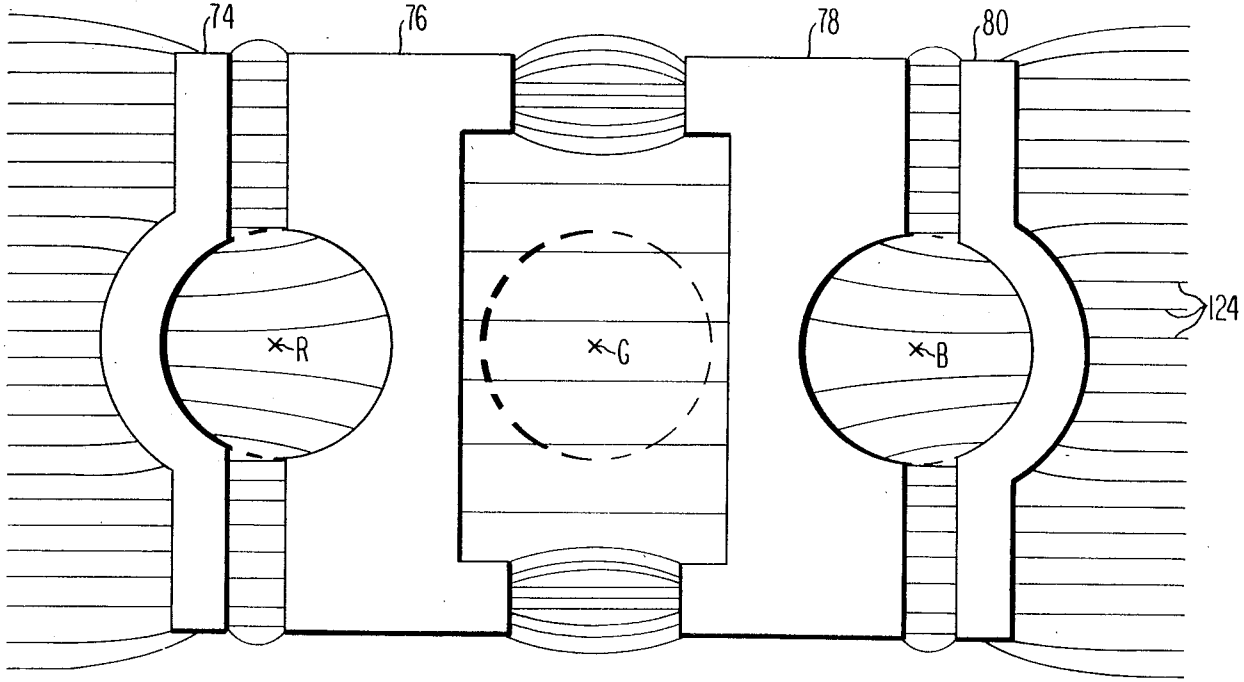
FIGS. 4 and 5 are plan views of novel coma correction members of the electron gun of FIG. 2, showing lines of flux of the vertical and horizontal magnetic deflection fields, respectively.

The effects that the coma correction members 74, 76, 78 and 80 have on the magnetic lines of flux 124 of a fringe portion of the vertical deflection field, at the members, are illustrated with respect to FIG. 4. The member 74 works in cooperation with the member 76, and the member 80 works in cooperation with the member 78, to bypass a part of the vertical deflection field around the two outer beam paths R and B, while allowing another part of the same fringe portion to pass through the two outer beam paths. The amount of the fringe portion that is bypassed around the outer beam paths can be varied by modifying the coma correction members to increase or decrease the gap between the inner and outer members.

The members 76 and 78 also work in cooperation with each other, to bypass a part of the fringe portion of the vertical deflection field around the center beam path G, while allowing another part of the same fringe portion to pass through the center beam path. The amount of the fringe portion that is bypassed around the center beam path can be varied by modifying the lengths of the legs 104 and 106, and 108 and 110, on the members 76 and 78, respectively. Increasing the lengths of the legs decreases the closest gap between the members 76 and 78 and thereby increases the amount of the fringe portion that is bypassed around the center beam path. Similarly, decreasing the lengths of the legs increases the closest gap between the legs and decreases the amount of the bypassed fringe portion.

Figure 5:
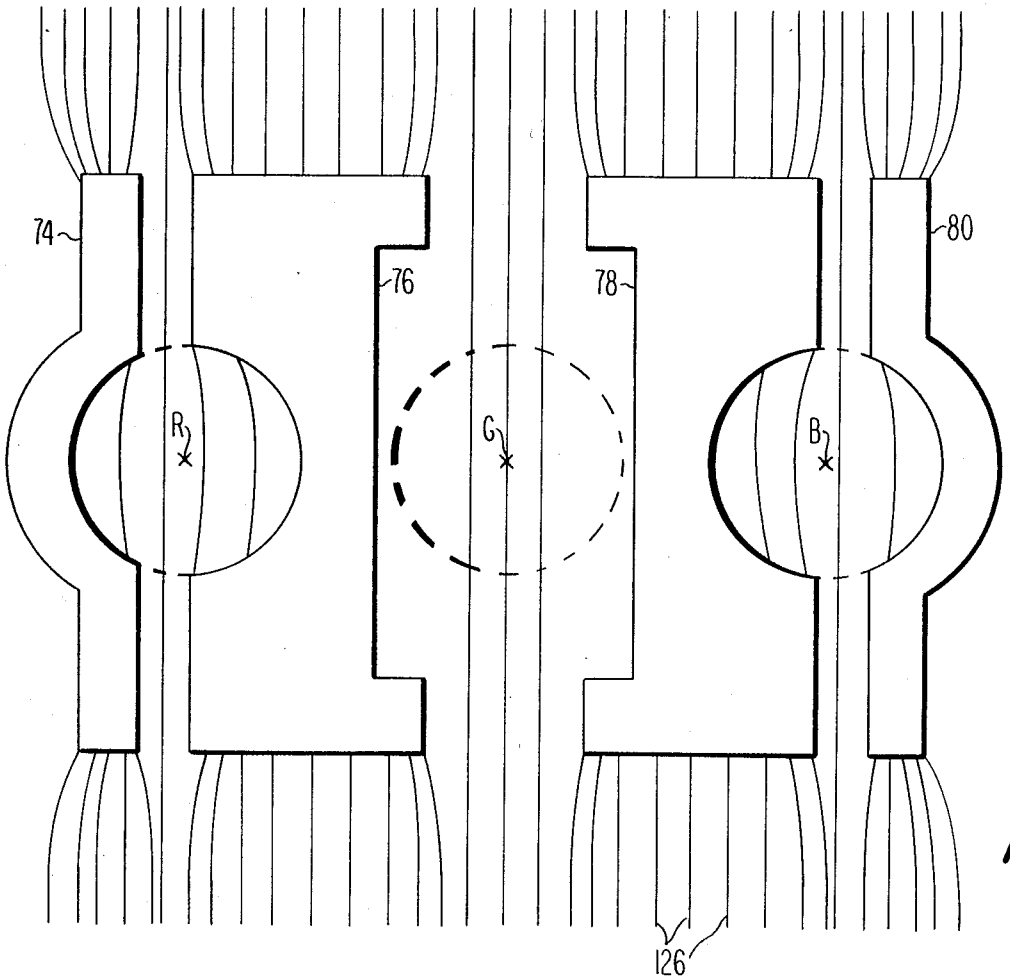

The effects that the coma correction members 74, 76, 78 and 80 have on the magnetic lines of the flux 126 of a fringe portion of the horizontal deflection field, at the members, are illustrated with respect to FIG. 5. The members 74 and 76 and the members 75 and 80 bypass a part of the fringe portion around the outer beam paths R and B, respectively. However, because of the spacing between the members, another part of the fringe portion passes through the outer beam paths. Again, by varying the shapes of the respective members and by adjusting the spacing between them, it is possible to finely control the amount of coma correction provided by the members.

The members 76 and 78 bypass a part of the fringe portion of the horizontal deflection field at the members around the center beam path G, while, because of their separation, they allow another part of the fringe portion to pass through the center beam path. Again, the amount of the fringe portion that is bypassed can be varied by varying the lengths of the legs 104, 106, 108 and 110 to intercept more or fewer of the respective lines of flux 126.

Although the fringe portion deflection field representations of FIGS. 4 and 5 are illustrated in two dimensions, it should be understood that they actually exist in three dimensions and that the coma correction members actually act on the three dimensional field in substantially the same manner as shown in the two dimensional representations.

By use of the novel coma correction members, it is possible to correct for many varied coma conditions. Such correction is possible by appropriate shaping and spacing of the members, without the need for varying the thickness of the member material. For example, if it is desired to increase the horizontal deflection of the outer beams relative to the center beam, the gaps between the members 74 and 76 and between members 78 and 80 may be expanded. The expanding of these gaps, however, also would increase the vertical deflection of the outer beams relative to the center beam. Therefore, the gaps between the members 76 and 78 would have to be expanded to compensate for this change. This expansion also has an effect on the horizontal deflection of the center beam. Because of these related effects, it can be seen that the proper design of the coma correction members to meet any particular coma problem requires the tradeoff of the various design parameters of the members discussed above. Also, it can be seen that because of the partial bypassing of the fringe portions of the deflection fields at the coma correction members, it is possible to correct for relatively minor coma problems by the use of thicker correction members than could be used in many of the previous coma correction member embodiments.

What is claimed is:

1. In a color picture tube having an inline electron gun for generating and directing three inline electron beams, comprising a center beam and two outer beams, along initially coplanar paths toward a screen of said tube, wherein the beams pass through a deflection zone adapted to have two orthogonal magnetic deflection fields established therein, a first of said fields causing deflection of the beams perpendicular to the inline direction of said beams, and a second of said fields causing deflection parallel to the inline direction of said beams, the improvement comprising said electron gun including four magnetically permeable members located near the exit of said electron gun in a fringe portion of said deflection zone, a first and a second of said members being located between the center beam path and a first and a second outer beam path, respectively, and a third and a fourth of said members being spaced from said first and second members, respectively, and being located on the outside of the respective outer beam paths, said first and third members and said second and fourth members having means for bypassing a part of the fringe portion of the first of the two orthogonal magnetic deflection fields, at said members, around the respective outer beam paths, while allowing another part of the same fringe portion, at said members, to pass through the respective outer beam paths, and said first and second members having means for bypassing a part of the fringe portion of the first of the two orthogonal deflection fields, at said members, around the center beam path while allowing another part of the same fringe portion, at said members, to pass through the center beam path.

2. In a color picture tube having an inline electron gun for generating and directing three inline electron beams, comprising a center beam and two outer beams, along initially coplanar paths toward a screen of said tube, wherein the beams pass through a deflection zone adapted to have two orthogonal magnetic deflection fields established therein, a first of said fields causing deflection of the beams perpendicular to the inline direction of said beams, and a second of said fields causing deflection parallel to the inline direction of said beams, the improvement comprising said electron gun including four magnetically permeable members located near the exit of said electron gun in a fringe portion of said deflection zone, a first and a second of said members being located between the center beam path and a first and a second outer beam path, respectively, and a third and a fourth of said members being spaced from said first and second members, respectively, and being located on the outside of the respective outer beam paths, said first member being spaced from said third member and said second member being spaced from said fourth member sufficient distances to bypass a part of the fringe portion of the second of the two orthogonal magnetic deflection fields, at said members, around the respective outer beam paths, while allowing another part of the same fringe portion, at said members, to pass through the respective outer beam paths, and said first and second members being spaced from each other a sufficient distance to bypass a part of the fringe portion of the second of the two orthogonal magnetic deflection fields, at said members, around the center beam path, while allowing another part of the same fringe portion, at said members, to pass through the center beam path.

3. In a color picture tube having an inline electron gun for generating and directing three inline electron beams, comprising a center beam and two outer beams, along initially coplanar paths toward a screen of said tube, wherein the beams pass through a deflection zone adapted to have two orthogonal magnetic deflection fields established therein, a first of said fields causing deflection of the beams perpendicular to the inline direction of said beams, and a second of said fields causing deflection parallel to the inline direction of said beams, the improvement comprising said electron gun including four magnetically permeable members located near the exit of said electron gun in a fringe portion of said deflection zone, a first and a second of said members being located between the center beam path and a first and a second outer beam path, respectively, and a third and a fourth of said members being spaced from said first and second members, respectively, and being located on the outside of the respective outer beam paths, said first and third members and said second and fourth members having means for bypassing a part of the fringe portion of the first of the two orthogonal magnetic deflection fields, at said members, around the respective outer beam paths, while allowing another part of the same fringe portion, at said members, to pass through the respective outer beam paths, said first and second members having means for bypassing a part of the fringe portion of the first of the two orthogonal deflection fields, at said members, around the center beam path, while allowing another part of the same fringe portion, at said members, to pass through the center beam path, said first member being spaced from said third member and said second member being spaced from said fourth member sufficient distances to bypass a part of the fringe portion of the second of the two orthogonal magnetic deflection fields, at said members, around the respective outer beam paths, while allowing another part of the same fringe portion, at said members, to pass through the respective outer beam paths, and said first and second members being spaced from each other a sufficient distance to bypass a part of the fringe portion of the second of the two orthogonal magnetic deflection fields, at said members, around the center beam path, while allowing another part of the same fringe portion, at said members, to pass through the center beam path.

4. In a color picture tube having an inline electron gun for generating and directing three inline electron beams, comprising a center beam and two outer beams, along initially coplanar paths toward a screen of said tube, wherein the beams pass through a deflection zone adapted to have two orthogonal magnetic deflection fields established therein, the improvement comprising said electron gun including four magnetically permeable members located near the exit of said electron gun in a fringe portion of said deflection zone, a first two of said members being located between the center beam path and the respective outer beam paths and a second two of said members being spaced from said first members and being located on the outside of the respective outer beam paths, the outward side of each of said first two members that faces an outer beam path including an inwardly curved arcuate portion partially surrounding the respective outer beam path and two other portions on opposite sides of said outer beam path that extend outward toward an adjacent one of said second two members, the inward side of each of said first two members including a straight central portion and inwardly extending legs at the opposite ends thereof, and the inward side of each of said second two members including an outwardly curved arcuate portion partially surrounding the respective outer beam paths and two other portions that extend inward toward the adjacent one of said first two members.

* * * * *